United States Patent [19]

Bayer

[11] Patent Number: 4,482,619

[45] Date of Patent: Nov. 13, 1984

[54] X-RAY ELECTRO-PHOTOGRAPHIC RECORDING MATERIAL AND METHOD FOR GENERATING AN ELECTRICAL CHARGE IMAGE IN SUCH MATERIAL

[75] Inventor: Eberhard Bayer, Munich, Fed. Rep. of Germany

[73] Assignee: Siemens Aktiengesellschaft, Berlin & Munich, Fed. Rep. of Germany

[21] Appl. No.: 493,808

[22] Filed: May 12, 1983

[30] Foreign Application Priority Data

Jul. 21, 1982 [DE] Fed. Rep. of Germany ..... 3227294

[51] Int. Cl.[3] ..... G03D 41/16; G03G 5/00

[52] U.S. Cl. ..... 430/84; 430/967; 378/32

[58] Field of Search ..... 430/60, 63, 64, 65, 430/84, 967; 378/28, 32

[56] References Cited

U.S. PATENT DOCUMENTS

| | | | |
|---|---|---|---|
| 3,003,869 | 10/1961 | Schattert | 430/60 |
| 4,129,779 | 12/1978 | Kingsley | 430/53 |
| 4,324,622 | 4/1982 | Deb | 430/63 |

OTHER PUBLICATIONS

R. M. Schaffert, *Electrophotography*, pp. 196–198, The Focal Press, London and New York.

Dr. Von H. Degenhardt, *Electromedicia*, vol. 3, (1981), pp. 154–158.

M. D. Tabak et al., "Preparation and Transport Properties of Vacuum Evaporated Selenium Films", *The Journal of Vacuum Science and Technology*, vol. 9, No. 1, (1972), pp. 387–390.

*Primary Examiner*—John E. Kittle
*Assistant Examiner*—John L. Goodrow
*Attorney, Agent, or Firm*—Hill, Van Santen, Steadman & Simpson

[57] ABSTRACT

An x-ray electro-photographic recording material is formed of a photo-conductive layer (1) comprised of a selenium-arsenic alloy and positioned on a transparent electrode layer (4), which is positioned on a further layer (3) comprised of an x-ray luminophore and positioned on a reflective surface (2*a*) of a film carrier layer (2). In usage, with a positive corona charge on the free photo-conductive layer surface (1*a*) before x-ray exposure, the luminophore-containing layer (3), during x-ray exposure, converts a component (5) of the x-ray radiation ($\gamma$) not absorbed by the photo-conductive layer (1) into visible luminescent light (6) which effects an increase of sensitivity in the photo-conductive layer (1). This recording material can be used in x-ray photograph devices.

8 Claims, 1 Drawing Figure

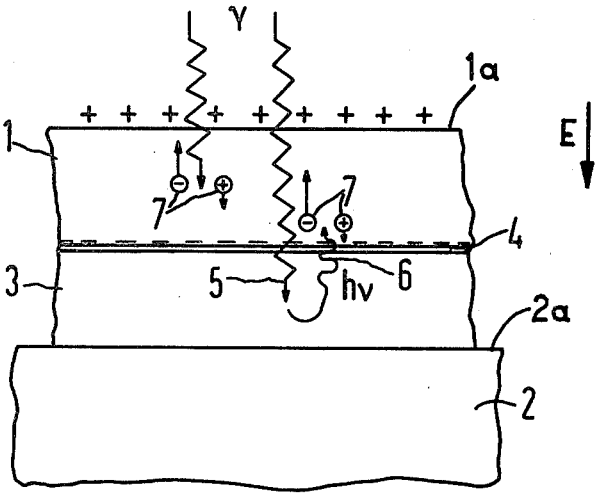
γ
1a
E
1
7
7
4
3
5
hν
6
2a
2

X-RAY ELECTRO-PHOTOGRAPHIC RECORDING MATERIAL AND METHOD FOR GENERATING AN ELECTRICAL CHARGE IMAGE IN SUCH MATERIAL

BACKGROUND OF THE INVENTION

1. Field of the Invention

The invention relates to x-ray photography and somewhat more particularly to an x-ray electro-photographic recording material comprised of a film carrier layer, a photo-conductive layer predominantly composed of selenium and an electrically-conductive layer positioned between the film carrier layer and the photo-conductive layer, as well as to a method of generating an electrical charge image on such recording material.

2. Prior Art

Selenium layers applied to metallic basis are principally utilized in x-ray electro-photography. The selenium layers are electrically charged and exposed through a desired master. The charge image produced, is developed by a toner powder and is transferred to an image receiving material. The utilization of such selenium plates is known, for example, from R. M. Schaffert, *Electrophotography,* pages 196–198, The Focal Press, London and New York.

It can also be derived from the above-referenced Schaffert book that x-ray photo-conductivity can be increased by small additions of heavy elements, such thallium to the selenium layer. The advantage of higher x-ray absorption thereby principally gained, is, however, in turn frequently restricted by the disadvantage of a reduction in mobility of the charge carriers connected therewith.

In x-ray films, it is known to utilize a rare earth oxysulfide for sensitizing x-ray films, see V. H. Degenhart, *Electromedicia,* Vol. 3, (1981) pages 154–158.

SUMMARY OF THE INVENTION

The invention provides a recording material for x-ray electro-photography having an increased sensitivity in a photo-conductive layer thereof without the prior art disadvantages noted above.

In accordance with the principles of the invention, an x-ray electro-photographic recording material having a film carrier layer, a photo-conductive layer predominantly composed of selenium and an electrically conductive layer positioned between the film carrier layer and the photo-conductive layer is improved by:

(a) forming the photo-conductive layer from a selenium-arsenic alloy;

(b) forming the electrically conductive layer from a transparent conductive material having inhibiting properties for negative charge carriers;

(c) providing the film carrier layer with a reflective surface facing the electrically-conductive layer; and (d) providing an intermediate layer comprised of an x-ray luminophore between the electrically conductive layer and the film carrier layer.

In certain embodiments of the invention, the photo-conductive layer is composed of a vapor-deposited selenium-arsenic compound or alloy having about 0.1 through 10 mol % of arsenic therein, and preferably consisting of $Se_{99.5}As_{0.5}$. The photo-conductive layer is preferably applied in a thickness in the range of about 50 through 300 μm.

In certain embodiment of the invention, the transparent electrically-conductive layer is composed of a material selected from the group consisting of aluminum, gold or an oxide mixture of 50 mol % indium and 50 mol % tin (ITO). Preferably, the transparent conductive layer is applied in a thickness in the range of about 10 through 20 nm.

In certain embodiments of the invention, the intermediate layer contains a rare-earth oxysulfide as the x-ray luminophore. Preferably, the intermediate layer is applied in the thickness in the range of about 1 through 10 μm.

As a result of the interpositioning of the x-ray luminophore-containing layer, a method of generating an electrical charge image in the x-ray electro-photographic recording material of the invention is provided whereby the free (uncovered) surface of the photo-conductive layer can be positively charged in the dark by a corona discharge from an appropriately applied electrical field, with the transparent electrically conductive layer functioning as a cooperating electrode so that a standard x-ray electro-photographic charge pattern developable with a toner, can be generated on the photo-conductive surface, now having a significant increase in sensitivity, in comparison to prior art arangements.

BRIEF DESCRIPTION OF THE DRAWINGS

The FIGURE is a fragmentary, elevated, schematic cross-sectional, view of an x-ray electro-photographic recording material constructed and operable in accordance with the principles of the invention.

DESCRIPTION OF THE PREFERRED EMBODIMENTS

The recording material of the invention contains an uppermost photo-conductive selenium arsenic layer 1 having a free or uncovered surface 1*a*. Preferably, layer 1 is produced by vapor-deposition on a substrate (formed of layers 2, 3 and 4) in a thickness of about 100 μm and can, preferably, be composed of $Se_{99.5}As_{0.5}$. The substrate is formed from a film carrier layer 2 having a reflective surface 2*a* and which can, preferably, be composed of aluminum, an intermediate layer 3, having a thickness of about 1 μm and comprised of an x-ray luminophore, such as a rare earth oxysulfide, positioned on the reflective surface 2*a* of the carrier layer 2 and an electrically conductive layer 4, composed of a transparent, conductive material having inhibiting properties for negative charge carriers positioned on the upper surface of layer 3. The electrically conductive layer 4, functioning as an electrode, can have a thickness of about 20 nm and, for example, can be composed of indium/tin-oxide (ITO).

In the exemplary embodiment illustrated, the free surface 1*a* of the photo-conductive layer 1 is positively charged in the dark by a corona discharge from an appropriately impressed electrical field E, with the transparent conductive layer 4 functioning as a cooperating electrode. As a result of the x-ray luminophore-containing layer 3, positioned below the transparent cooperating electrode 4, a component (see arrow 5) of irradiated x-ray radiation ($\gamma$) not absorbed by the selenium-arsenic layer 1 can now be effectively converted into visible luminescent light ($h\sigma$, see arrow 6) and reflected through the transparent electrode 4 to the negatively charged side of the photo-conductive layer 1. With this arrangement, the luminescent light (6) contributes with high efficiency to the production of a desired x-ray electro-photographic charge pattern in layer 1. The symbols referenced with arrows 7 indicate the respective charges, with the length of the respective arrows indicating the approximate charge mobility.

A numerical example is presented below to illustrate the light sensitivity of a typical 300 μm thick $Se_{99.5}As_{0.5}$ layer, with exposure occuring from the negatively charged side thereof:

A plate consisting of the foregoing layer was exposed with a 15 μWs/cm² green filter light (incondescent lamp through a 2 mm Schott glass BG 18) produced a contrast potential of 1.9 kV at 2 kV charging potential in the dark. Conversely, a contrast potential of only 20 V was noted with a positive charging to 2 kV after the same exposure. This polarity dependency of light sensitivity is in agreement with the relationships between thrust paths for electrons and holes as a function of arsenic concentration known from the literature (see an article by M. D. Tabak and W. J. Hillegas, Journal of Vacuum Science and Technology, Vol. 9, 1972, pages 387–390). However, this literature does not suggest what arsenic concentration provides an optimum for attaining as a great an electron thrust path as possible.

By following the principles of the invention, one can considerably reduce the layer thickness of a standard photo-conductor in x-ray electro-photography. The component of x-ray radiation converted into charge carriers directly in the photo-conductive layer is indeed reduced. On the other hand, the component gained over luminescence is increased and, advantageously, the charge transport loss for both components is also simultaneously reduced.

As is apparent from the foregoing specification, the present invention is susceptible of being embodied with various alterations and modifications which may differ particularly from those that have been described in the precedings specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

I claim as my invention:

1. A method of generating an electrical charge image in a x-ray electro-photographic recording material comprised of successive contacting layers identified as follows:

(a) an upper photo-conductive layer composed of a vapor-deposited selenium-arsenic alloy having from about 0.1 through 10 mole percent of arsenic therein and having a free surface, (b) an electrically-conductive layer composed of a transparent conductive material having inhibiting properties for negative charge carriers, (c) an intermediate layer comprised of an x-ray luminophore, and (d) a lower film carrier layer having a reflective surface facing said intermediate layer, said method comprising the steps of:

positively charging said free surface of said photo-conductive layer in the dark by a corona discharge from an applied electrical field while maintaining said electrically conductive transparent layer as a cooperating electrode, thereby to produce a sensitive charge on said surface; and exposing said so-charged surface to an x-ray image, thereby to produce on said surface an x-ray electro-photographic charge pattern which is developable with a toner.

2. The method according to claim 1 wherein, in said x-ray electro-photographic recording material, said selenium-arsenic alloy consists of $Se_{99.5}As_{0.5}$.

3. The method of claim 1 wherein, in said x-ray electro-photographic recording material, said photo-conductive layer has a thickness in the range of about 50 through 300 μm.

4. The method of claim 1 wherein, in said x-ray electro-photographic recording material, said transparent, conductive material forming said electrically-conductive layer is selected from the group consisting of gold, aluminum, and an oxide mixture of 50 mol% indium and 50 mol% tin.

5. The method of claim 4 wherein said electrically-conductive layer has a thickness in the range of about 10 through 20 nm.

6. The method of claim 1 wherein, in said x-ray electro-photographic recording material, said x-ray luminophore in said intermediate layer is a rare earth oxysulfide.

7. The method of claim 6 wherein said intermediate layer has a thickness in the range of about 1 through 10 μm.

8. The method of claim 1 wherein, in said x-ray electro-photographic recording material, said film carrier layer is composed of aluminum.

* * * * *